US009417606B2

(12) United States Patent
Asami et al.

(10) Patent No.: US 9,417,606 B2
(45) Date of Patent: Aug. 16, 2016

(54) IMAGE FORMING APPARATUS HAVING CONTROL MEANS TO REDUCE AN AMOUNT OF THE WATER VAPOR PRODUCED IN A MAIN ASSEMBLY THEREOF OR DETECTING UNIT CONFIGURED TO DETECT A VALUE RELATING TO AN AMOUNT OF WATER VAPOR IN THE MAIN ASSEMBLY

(71) Applicant: CANON KABUSHIKI KAISHA, Tokyo (JP)

(72) Inventors: Jun Asami, Susono (JP); Hirohiko Aiba, Suntou-gun (JP); Masaki Hirose, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/670,843

(22) Filed: Mar. 27, 2015

(65) Prior Publication Data

US 2015/0277371 A1 Oct. 1, 2015

(30) Foreign Application Priority Data

Mar. 28, 2014 (JP) ..... 2014-070602

(51) Int. Cl.
*G03G 21/20* (2006.01)
*G03G 15/20* (2006.01)

(52) U.S. Cl.
CPC ..... *G03G 21/203* (2013.01); *G03G 15/2039* (2013.01)

(58) Field of Classification Search
CPC ..... G03G 21/203; G03G 15/16; G03G 21/20; G03G 2215/00776
USPC ..... 399/97, 44
See application file for complete search history.

(56) References Cited

U.S. PATENT DOCUMENTS

| | | | | |
|---|---|---|---|---|
| 6,389,247 | B1 * | 5/2002 | Chung | G03G 15/2003 399/44 |
| 7,389,079 | B2 | 6/2008 | Narahara et al. | |
| 8,600,259 | B2 | 12/2013 | Oi et al. | |
| 2003/0156871 | A1 * | 8/2003 | Carlson | B41J 13/103 399/390 |
| 2009/0060561 | A1 * | 3/2009 | Okabayashi | G03G 15/2039 399/94 |

(Continued)

FOREIGN PATENT DOCUMENTS

| | | |
|---|---|---|
| JP | 2-123385 | 5/1990 |
| JP | 4-44075 | 2/1992 |

(Continued)

OTHER PUBLICATIONS

U.S. Appl. No. 14/669,517, dated Mar. 26, 2015.

*Primary Examiner* — Rodney Bonnette
(74) *Attorney, Agent, or Firm* — Fitzpatrick, Cella, Harper & Scinto

(57) ABSTRACT

An image forming apparatus includes: a main assembly; an image bearing member; a transfer member cooperative with the image bearing member to form a transfer portion; a voltage source for applying a voltage to the transfer member; a heater for heating the sheet having a transferred toner image; a detector for detecting a value relating to an amount of water vapor in the main assembly; and a control unit for executing a moisture removing control for reducing an amount of water vapor produced in the main assembly, by heating the sheet by the heater on the basis of the amount of change, caused by passage of the sheet in an image forming operation, of the value detected by the detector.

15 Claims, 10 Drawing Sheets

(56) References Cited

U.S. PATENT DOCUMENTS

| | | | | |
|---|---|---|---|---|
| 2014/0105621 | A1* | 4/2014 | Imanaka ..... | G03G 15/0266 399/26 |
| 2015/0253704 | A1 | 9/2015 | Hirose et al. | |

FOREIGN PATENT DOCUMENTS

| | | |
|---|---|---|
| JP | 2001-290316 | 10/2001 |
| JP | 2013-130709 | 7/2013 |

* cited by examiner

IMAGE FORMING APPARATUS HAVING CONTROL MEANS TO REDUCE AN AMOUNT OF THE WATER VAPOR PRODUCED IN A MAIN ASSEMBLY THEREOF OR DETECTING UNIT CONFIGURED TO DETECT A VALUE RELATING TO AN AMOUNT OF WATER VAPOR IN THE MAIN ASSEMBLY

FIELD OF THE INVENTION AND RELATED ART

The present invention relates to an image forming apparatus such as a copying machine, a laser beam printer, a facsimile machine, etc., which uses an electrophotographic method or an electrostatic recording method.

Conventionally, in an image forming apparatus which uses an electrophotographic method or an electrostatic recording method, a toner image is formed on an image bearing member such as an electrophotographic photosensitive member, an electrostatically recordable dielectric member, an intermediary transfer member, etc., through an image formation process that is appropriate to the type of the image bearing member. The toner image formed on the image bearing member is transferred by a transferring means, onto recording medium such as a sheet of recording paper (transfer paper). Then, the toner image on the recording medium is thermally fixed to the recording medium by a fixing means. Then, the recording medium is outputted as a print (copy) from the main assembly of the image forming apparatus.

As a transferring means for transferring a toner image from the image bearing member onto the recording medium, in an image forming apparatus such as the above-described one, a transfer roller is widely used. The process of transferring a toner image with the use of a transfer roller is as follows. That is, a transfer roller that has electrical conductivity and elasticity is placed in contact with the image bearing member, whereby a transfer nip, or the transfer section (transfer position), is formed. A sheet of a recording medium on which a toner image is present is guided into the transfer nip, and is conveyed through the transfer nip while remaining pinched by the image bearing member and transfer roller. While the sheet of the recording medium is conveyed through the transfer nip, a transfer voltage which is opposite in polarity from the electric charge of the toner, is applied to the transfer roller. Thus, the toner image on the image bearing member is electrostatically transferred onto the surface of the sheet of the recording medium (electrostatic transfer).

One of the known methods for controlling transfer voltage is ATVC (Active Transfer Voltage Control), which can properly control the transfer voltage by estimating the amount of the electrical resistance of a transfer roller. More concretely, according to ATVC, during the pre-rotation process, which is a preparatory operation to be carried out prior to the starting of the image formation process, a preset amount of electrical current flows to the image bearing member from the transfer roller, and the amount of the electrical resistance of the transfer roller is estimated from the amount of voltage which was necessary to cause to flow the preset amount of the electric current. Then, during the transfer process in which a toner image is actually transferred, such transfer voltage that is proportional to the estimated amount of electrical resistance of the transfer roller is applied to the transfer roller.

On the other hand, as a fixing means for thermally fixing a toner image on a sheet of a recording medium, a thermal fixation unit (which hereafter may be referred to simply as "fixation unit") of the heat-roller type, or heat film type, is widely in use. A fixation unit of the heat-roller type has a pressure roller (fixation roller) which is kept stable in temperature at a preset level, and a pressure roller which has an elastic layer and forms a fixation nip by being pressed upon the heat roller. In operation, a sheet of a recording medium is introduced into the fixation nip, and is conveyed through the fixation nip while remaining pinched by the heat roller and the pressure roller. Thus, the toner image is thermally fixed to the sheet of the recording medium by the heat from the heat roller. A fixation unit of the heat-film type has a heating member, a film (which hereafter may be referred to simply as "fixation film") which slides on the heating member, and a pressuring member which forms a fixation nip in coordination with the heating member, with the presence of the fixation film between itself and the heating member. In operation, a sheet of the recording medium on which a toner image is present is guided into the fixation nip, and is conveyed through the fixation nip while remaining pinched by the fixation film and the pressing member. Thus, the toner image is thermally fixed to the sheet of the recording medium by the heat which is transmitted to the sheet from the heating member through the fixation film.

By the way, in a case where a sheet of a recording medium (which hereafter may be referred to simply as a "moist sheet of paper") which is relatively high in water content, is introduced into the fixation nip of the fixation unit, a greater amount of water vapor is generated as the sheet is suddenly heated to a high temperature than in a case where a sheet of a recording medium (which hereafter may be referred to simply as a "dry paper") which is relatively low in water content. Thus, when images are continuously formed on a large number of moist sheets of paper, a large amount of water vapor is generated in a short period of time, condenses into water droplets, which adhere to the recording medium passage, thereby increasing the friction between the sheet of the recording medium and the recording medium passage. With the increase in the friction between the sheet of the recording medium and the recording medium passage, it is possible the recording medium is conveyed, its corner(s) may be bent, and/or it may be wrinkled.

One of the methods for preventing the generation of water vapor is disclosed in Japanese Laid-open Patent Application 2001-290316. According to this application, while a sheet of the recording medium is conveyed through the transfer nip, the amount of electric current which flows through the transferring means is measured. If the amount of the electric current becomes higher than a preset value, it is determined that the sheet of the recording medium which is being used for image formation is a moist sheet of paper. Then, the temperature setting of the fixation unit is adjusted to minimize the water vapor generation.

However, even in a case where the recording medium used for image formation is a moist sheet of paper, if the recording medium is thick or coarse, it is relatively large in electrical resistance, and therefore, the amount of electrical current flowing to the transferring means is relatively small. In addition, in a case where a toner image formed on such a sheet of a recording medium (transfer medium) has a large in the amount of toner, the amount of electric current flowing to the transferring means is significantly affected by the impedance attributable to the toner. Thus, the amount of electric current flowing to the transferring means becomes even smaller. On the other hand, even in a case where the recording medium is "dry" paper, if it is low in electrical resistance, and the toner image on the recording medium has a small amount of toner, the amount of electric current flowing to the transferring means is large.

That is, the amount of electric current flowing to the transferring means is affected by not only the amount of water content of the transfer medium, but also, by the amount of electrical resistance of the transfer medium, and the amount of toner in the toner image on the transfer medium. Therefore, the method disclosed in Japanese Laid-open Patent Application 2001-290316 cannot accurately determine whether or not the transfer medium is a moist sheet of paper, and therefore, it sometimes fails to control the water vapor generation, and/or remove the generated water vapor.

SUMMARY OF THE INVENTION

Thus, the primary object of the present invention is to provide an image forming apparatus which can accurately detect whether or not the recording medium which is being used for image formation is a moist sheet of paper, that is, paper which is relatively high in water content, and therefore, can properly control the water vapor generation, and/or remove the generated water vapor.

According to an aspect of the present invention, there is provided an image forming apparatus comprising: a main assembly; an image bearing member for carrying a toner image; a transfer member cooperative with the image bearing member to form a transfer portion to transfer a toner image onto a recording material pass the transfer member; a heating unit for heating the recording material having a transferred toner image; a detecting unit for detecting a value relating to an amount of water vapor in the main assembly; and a control unit for executing a moisture removing control for reducing an amount of water vapor producing or produced in the main assembly, by heating the recording material by the heating unit on the basis of the amount of change, caused by passage of the recording material in an image forming operation, of the value detected by the detecting unit.

According to another aspect of the present invention, there is provided an image forming apparatus comprising a main assembly; an image bearing member for carrying a toner image; a transfer member cooperative with the image bearing member to form a transfer portion to transfer a toner image onto a recording material passing through the transfer portion; a transferring voltage source for applying a voltage to the transfer member; a detecting unit for detecting a voltage applied by the transferring voltage source; a heating unit for heating the recording material having a transferred toner image; and a control unit for controlling the heating unit. The detecting unit detects a first voltage at first timing at which the recording material is not in the transfer portion, and after the heating unit heats at least one recording material thereafter. In addition, the detecting unit detects a second voltage having the same polarity as the first voltage and having an absolute value smaller than that of the first voltage, at second timing at which the recording material is not in the transfer portion. Also, the control unit controls the heating unit on the basis of a difference between the first voltage and the second voltage so as to reduce an amount of the water vapor producing in the main assembly.

According to a further aspect of the present invention, there is provided an image forming apparatus comprising; a main assembly; an image bearing member for carrying a toner image; a transfer member cooperative with the image bearing member to form a transfer portion to transfer a toner image onto a recording material passing through the transfer portion; a transferring voltage source for applying a voltage to the transfer member; a detecting unit for detecting a voltage for applying by the transferring voltage source; a heating unit for heating the recording material having a transferred toner image; a fan for controlling a flow rate in the main assembly; and a control unit for controlling the fan. The control unit detects a first voltage at first timing at which the recording material is not in the transfer portion, and after the heating unit heats at least one recording material thereafter, the detecting unit detects a second voltage having the same polarity as the first voltage and having an absolute value smaller than that of the first voltage, at a second timing at which the recording material is not in the transfer portion. In addition, the control unit controls the fan on the basis of a difference between the first voltage and the second voltage so as to reduce an amount of the water vapor produced in the main assembly.

Further features of the present invention will become apparent from the following description of exemplary embodiments with reference to the attached drawings.

DESCRIPTION OF THE EMBODIMENTS

Hereinafter, image forming apparatuses which are in accordance with the present invention are described in detail with reference to appended drawings.

[Embodiment 1]

(1) Overall Structure and Operation of Image Forming Apparatus

Figure 1:
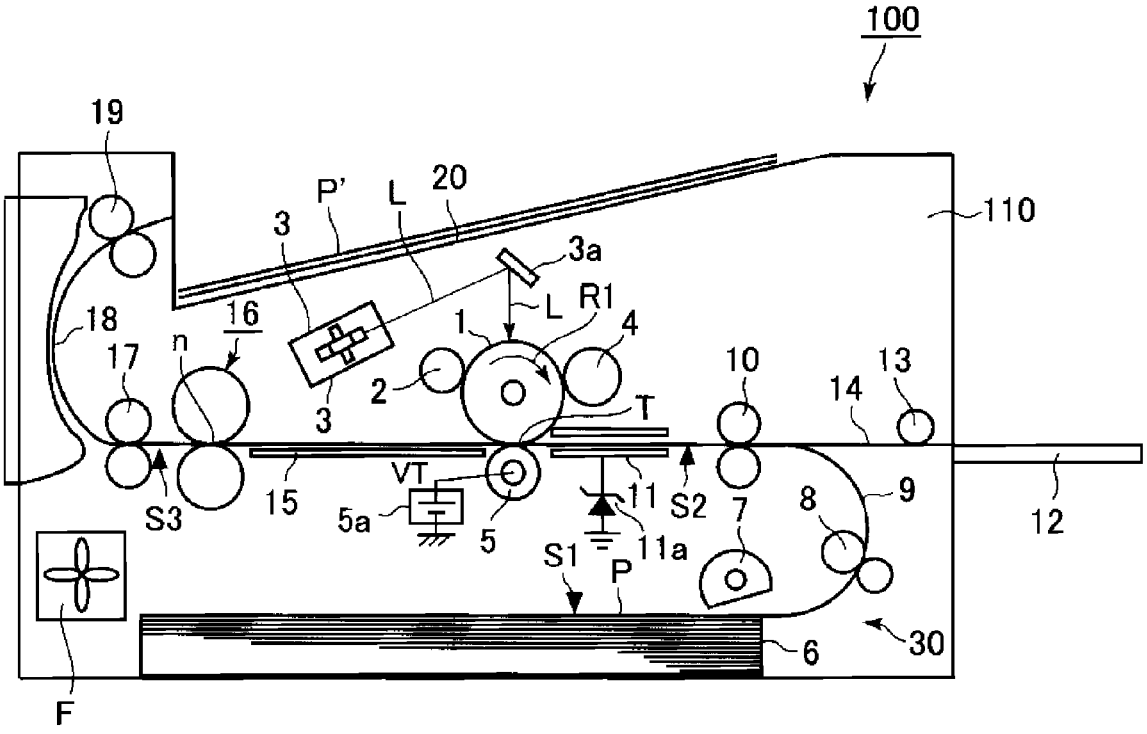
FIG. 1 is a schematic sectional view of a typical image forming apparatus to which the present invention is applicable.

FIG. 1 is a schematic sectional view of the image forming apparatus in the first embodiment of the present invention. The image forming apparatus 100 in this embodiment is a laser beam printer which uses an electrophotographic process of the so-called transfer type. This image forming apparatus 100 receives image formation data (printing data) from a host computer, and develops the data into image information (dot map). Then, it forms an image on a sheet P of a recording medium with the use of its electrophotographic engine section, which is in its main assembly 110, based on the image information. Here, a sheet P of the recording medium may be referred to as a sheet P of ordinary paper. However, this embodiment is not intended to limit the present invention in scope in terms of the recording medium.

The electrophotographic engine section is provided with an electrophotographic photosensitive member (photosensitive drum 1), as an image bearing member, which is in the form of a drum (cylindrical drum). The photosensitive drum 1 is rotationally driven at a preset peripheral velocity in the clockwise direction indicated by an arrow mark R1 in the drawing. As the photosensitive drum 1 is rotationally driven, the peripheral surface of the photosensitive drum 1 is uniformly charged to a preset potential level, −700 V, for example, by a charge roller 2, as the primary charging means, which is in the form of a roller. Then, the uniformly charged peripheral surface of the photosensitive drum 1 is scanned by (exposed to) the beam L of laser light outputted from the laser section of a laser scanner 3 as an image exposing means. More concretely, the laser scanner 3 outputs, with the use of its laser section, a beam L of laser light while modulating (turning on or off) the beam L according to the image data outputted by an image controller (unshown), which is an image developing section. Consequently, an electrostatic latent image (electrostatic image), which reflects the image information, is formed on the peripheral surface of the photosensitive drum 1. Incidentally, as the beam L of laser light is outputted from the scanner 3, it is directed by a mirror 3*a* to the points of the peripheral surface of the photosensitive drum 1, which are to be exposed. The electrostatic latent image formed on the peripheral surface of the photosensitive drum 1 is developed into a toner image by a developing device 4 as a developing means. In this embodiment, toner as developer is negative toner. That is, in this embodiment, the polarity (normal polarity) to which toner is charged for development is minus (negative). Further, in this embodiment, an electrostatic image is developed in reverse. That is, a toner image is formed by adhering the charged toner which is the same in polarity as the photosensitive drum 1, to the points of the peripheral surface of the photosensitive drum 1 whose potential-level absolute value has been reduced by being exposed after the peripheral surface of the photosensitive drum 1 was uniformly charged.

There is disposed a transfer roller 5, as a transferring means, which is a transferring member in the form of a roller, on the bottom side of the photosensitive drum 1 with reference to the drawing. The transfer roller 5 is kept pressed upon the peripheral surface of the photosensitive drum 1 with the application of a preset amount of force. The area of contact between the transfer roller 5 and the photosensitive drum 1 is the transfer nip T (transfer section, transfer position). The transfer roller 5 is an example of a transferring member which transfers a toner image from the image bearing member onto a sheet of a recording medium as voltage is applied to the transfer roller 5, in the transfer nip. While a toner image is formed on the peripheral surface of the photosensitive drum 1, a sheet P of the recording medium, such as recording paper, is conveyed to the transfer nip T from a sheet feeder cassette 6 as the first sheet feeding means, or a manual sheet feeder tray 12 (MP tray) as the second sheet feeding means, with a preset control timing. Then, the sheet P is introduced into the transfer nip T, and is conveyed through the nip T while remaining pinched between the photosensitive drum 1 and the transfer roller 5. While the sheet P is conveyed through the transfer nip T, a transfer voltage (transfer bias), which is a DC voltage, is applied, while being controlled so that its value remains at a preset value VT, to the transfer roller 5 from a transfer power source 5*a* as a voltage applying means. The polarity of the transfer voltage is positive. That is, it is opposite from the normal polarity of the toner. Thus, as the transfer voltage is applied to the transfer roller 5, the toner image on the photosensitive drum 1 is electrostatically transferred onto the surface of the sheet P as if it is peeled away from the photosensitive drum 1, in the transfer nip T. In this embodiment, the value VT of the transfer voltage which is to be applied to the transfer roller 5 during the transfer process in a printing operation is set through the ATVC sequence carried out during the pre-rotation process in the printing operation (which will be described later). This voltage value VT is obtained based on the voltage value Vt0, through the ATVC carried out in the pre-rotation process. The voltage value VT may be Vt0. Further, it may be a value derived from Vt0 with the use of a computation formula, a lookup table, etc., which are provided in advance.

When the image forming apparatus 100 is in the mode in which sheets P of the recording medium are fed into the main assembly of the image forming apparatus 100 from the sheet feeder cassette 6, the sheets P stored in layers in the sheet feeder cassette 6 are fed one by one into the apparatus main assembly while being separated from those remaining in the cassette 6. Then, each sheet P is sequentially conveyed through, or by, a pair of sheet conveyance rollers 8, a sheet passage 9 (passage for feeding from cassette), a pair of conveyance rollers 10, a leading edge detection sensor S2, and an upstream transfer guiding plate 11 (upstream conveyance passage), in the listed order, and then, is guided into the transfer nip T. In comparison, when the image forming apparatus 100 is in the mode in which sheets P are fed into the main assembly of the image forming apparatus 100 through a manual feed tray 12, one of the sheets P which were set in layers in the manual feed tray 12 is separated from the rest by the rotation of the feed roller 13. Then, this sheet P is sequentially conveyed further through, or by, a sheet passage 14 (manual feed sheet passage), the pair of conveyance rollers 10, the leading edge detection sensor S2, and the upstream transfer nip guide plate 11 (upstream conveyance passage), in the listed order, and then, is guided into the transfer nip T.

The timing, or the like, with which the image formation sequence for forming an image on a sheet P of the recording medium, is set according to the point in time at which the leading edge of a sheet P of the recording medium is detected by the leading edge detection sensor S2 disposed on the recording medium outlet side of the pair of conveyance rollers 10. That is, as the leading edge of each sheet P of the recording medium is detected by the leading edge detection sensor S2, the above-described image controller outputs image data. Then, the beam L of laser light outputted from the laser section of the laser scanner 3 is turned on or off according to the image data, while the peripheral surface of the photosensitive drum 1 is scanned by (exposed to) the beam L. By the way, the presence or absence of a sheet P of the recording medium in the sheet feeder cassette 6 is detected by a sensor S1. Further, the upstream guide plate 11 (upstream conveyance passage) of the transfer nip T is connected to a voltage control component 11*a* so that the guide plate 11 on the upstream side of the transfer nip T remains constant in voltage at a preset level. In some cases, this voltage control component 1la is not employed by the image forming apparatus 100 because of the electrical properties of the image forming apparatus 100.

As the sheet P of the recording medium is conveyed through the transfer nip T, it peels itself away from the peripheral surface of the photosensitive drum 1. Then, it is guided by the pre-fixation guiding plates 15 (pre-fixation conveyance passage), into the fixation nip n of the fixation unit 16 as a fixing means in which the toner image is thermally fixed. The fixation unit 16 in this embodiment is of the so-called heat-film type, which will be described later in detail.

After the sheet P of the recording medium comes out of the fixation unit 16, it is conveyed further by, or through, the pair of conveyance rollers 17, a sheet passage 18 (post-fixation sheet passage), and a pair of conveyance rollers 19. Then, it is outputted, as a print P, from the main assembly 110 of the image forming apparatus 100, into a delivery tray 20 so that it will be cumulatively placed in the tray 20. Whether or not the sheet P has been discharged into the delivery tray 20 after the toner image was thermally fixed to the sheet P is detected by a sheet discharge sensor S3.

The image forming apparatus 100 has a fan F, which is capable of drawing air into the apparatus main assembly 110 from outside the apparatus main assembly 110, or exhausting air from within the apparatus main assembly 110. How the fan F is used does not matter as long as its rotation affects the amount of water vapor (including amount of water droplets having adhered to the recording medium conveyance passage) in the apparatus main assembly 110. For example, it may be such a fan, the main usage of which is to exhaust the air in the apparatus main assembly 110, which was warmed up by the heat generating member (fixation unit 16, for example) in the apparatus main assembly 110, or to draw air into the apparatus main assembly 110 from outside the apparatus main assembly 110 to cool the heat generating member (fixation unit 16, etc.) in the apparatus main assembly 110.

(2) Fixation unit

Figure 2:
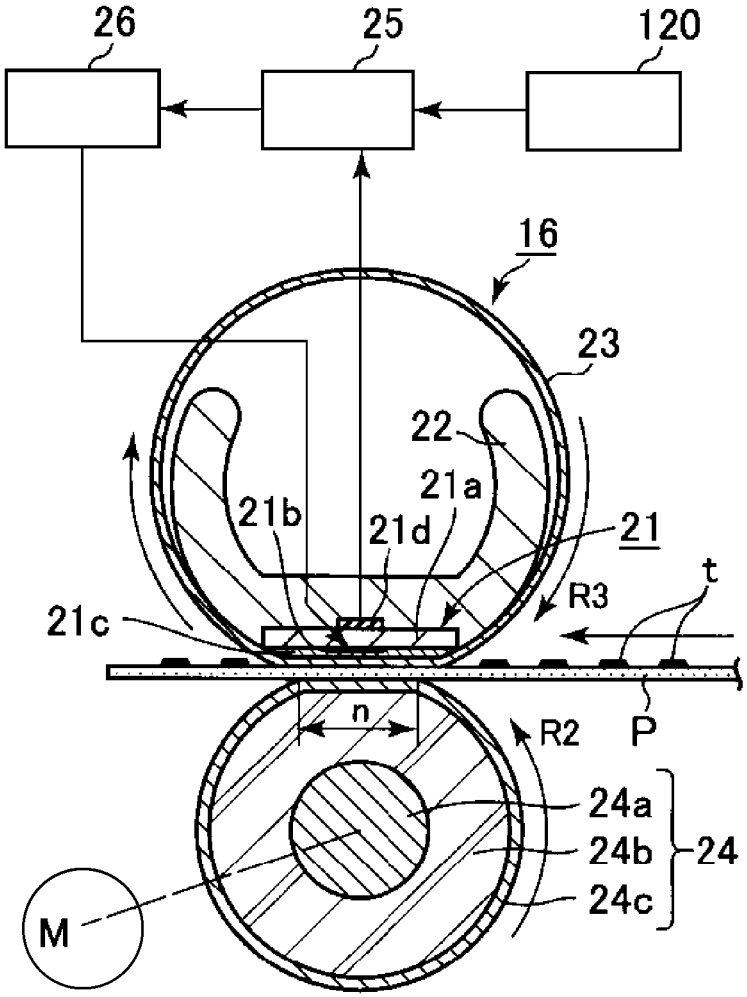
FIG. 2 is a schematic sectional view of the fixation unit in the first embodiment of the present invention.

FIG. 2 is a schematic sectional view of the fixation unit 16 as a fixing means in this embodiment. This fixation unit 16 as a fixing means is an example of a heating means for heating the recording medium after the transfer of a toner image onto the recording medium. In particular, the fixation unit 16 in this embodiment is an image heating device of the so-called heat-film type, and also, of the so-called tensionless type.

The fixation unit 16 has: a ceramic heater 21 (heater) as a heat generating member; a heating member supporting member 22, which is in the form of a trough that is roughly semicircular in cross section; a heat resistant cylindrical film 23 (fixation film); and an elastic pressure roller 24 (pressure roller) as a pressing member.

The heater 21 is a long and narrow member, the lengthwise direction of which is perpendicular to the surface of the sheet of paper, as shown in FIG. 2. The heater 21 in this embodiment has: a substrate 21*a* formed of such ceramic as alumina; and an electrically resistant layer 21*b*, which is formed of sliver-palladium (Ag—Pd), on one of the primary surfaces of the substrate 21*a*, and which generates heat as electrical current flows through it. Further, the heater 21 has also: a heater cover layer 21*c* formed of heat resistant glass or the like to cover the generating resistant layer 21*b* and the substrate 21*a*; and a temperature detection element 21*d*, such as a thermistor, disposed on the opposite surface of the substrate 21*a* from the heat generating resistant layer 21*b*. The heater 21 is relatively small in thermal capacity, being therefore, very responsive. That is, as the electrical power supply to the heat generating resistant layer 21*b* is turned on or off, the heater 21 quickly increases or decreases in temperature.

The heating member supporting member 22 is heat resistant and a dielectric. It is made of a rigid substance, such as PPS (polyphenylsulfide), PAI (polyamide imide), PI (polyamide), PEEK (polyether-ether-ketone), etc., which can withstand a substantial amount of weight. The heater 21 is supported by the heating member supporting member 22. More specifically, the bottom surface of the heating member supporting member 22, with reference to FIG. 2, is provided with a long groove, which is roughly in the middle of the surface, in terms of the direction parallel to the recording medium conveyance direction, and which extends in the direction perpendicular to the recording medium conveyance direction. It is in this groove that the heater 21 is fixed in such an attitude that the heater cover layer 21*c* faces outward of the groove.

The fixation film 23 is a heat resistant film, which is rough 40 μm - 100 μm, for example, in thickness. It is made up of a polyimide film or the like, as a substrative layer, and a non-adhesive and heat resistant layer which is formed of PFA, PTFE, or the like, and which covers the substrative layer. It is loosely fitted around the heating member supporting member 22, to which the heater 21 is fixed, as described above to be supported by the heating member supporting member 22.

The pressure roller 24 has: a metallic core 24*a*; a roller layer 24*b*, which is coaxial with the metallic core 24*a* and is formed of an elastic and heat resistant substance, such as silicone rubber; and a surface layer 24*c*. The pressure roller 24 is rotatably supported by the front and rear (with reference to FIGS. 1 and 2) plates of the chassis of the image forming apparatus 100, being positioned between the two plates. More concretely, the lengthwise ends of the metallic core 24*a* are rotatably supported by the front and rear plates, one for one, of the chassis of the image forming apparatus 100, with the placement of a pair of bearings between the pressure roller 24 and front and rear plates, one for one. Further, the heating member supporting member 22, which supports the heater 21 by its downwardly facing surface, and around which the cylindrical film 21 is fitted, is disposed so that the heater 21 faces the upwardly facing surface (FIG. 2) of the pressure roller 24. Further, the heating member supporting member 22 is held so that it is kept pressed against the upwardly facing surface of the pressure roller 24 with the application of a preset amount of force by a pressure applying means (unshown). Thus, the fixation nip n, which has a preset width, is formed between the downwardly facing surface of the heater 21, and the upwardly facing surface of the pressure roller 24, with the presence of the fixation film 23 between the heater 21 and the pressure roller 24.

The pressure roller 24 is rotationally driven by a fixing device driving mechanism M as a driving means, in the counterclockwise direction indicated by an arrow mark R2 in the drawing, at a preset peripheral velocity. As the pressure roller 24 is rotationally driven, friction is generated between the pressure roller 24, which remains pressed upon the fixation film 23, and the outward surface of the fixation film 23, in the fixation nip n. The friction works in the direction to rotationally move the fixation film 23. Thus, the fixation film 23 rotates around the heating member supporting member 22 in the clockwise direction indicated by an arrow mark R3 in the drawing at a peripheral velocity which is proportional to the peripheral velocity of the pressure roller 24, while sliding on the downwardly facing surface of the heater 21, with the presence of no gap between the fixation film 23 and pressure roller 24 in the fixation nip n (pressure roller driving type). The heating member supporting member 22 plays not only a role of holding the heater 21, but also, a role of a film guide which ensures that the fixation film 23 remains stable in its rotational movement (conveyance).

As the pressure roller 24 is rotationally driven, the fixation film 23 is circularly moved around the heating member supporting member 22 by the rotation of the pressure roller 24. As the heater 21 is supplied with electrical power, the heater 21 generates heat. Thus, the temperature of the fixation nip n is increased by the heat from the heater 21 to a preset level, and is kept at the preset level. While the fixation unit 16 is in the state described above, a sheet P of the recording medium, on which an unfixed toner image is present, is guided into the fixation nip n, and is conveyed through the fixation nip n, along with the fixation film 23, with the surface of the fixation film 23 remaining in contact with the outward surface of the fixation film 23 in such a manner that there is no gap between the sheet P and the fixation film 23, that is, remaining pinched between the fixation film 23 and the pressure roller 24. While the sheet P is conveyed through the fixation nip n as described above, the heat from the heater 21 is given to the sheet P through the fixation film 23. Thus, the unfixed toner image t on the sheet P is fixed to the sheet P by the heat from the heater 21 and the pressure in the fixation nip n. As the sheet P begins to be conveyed out of the fixation nip n, it is separated from the outward surface of the fixation film 23 by the curvature of the fixation film 23 (heating member supporting member 22). Then, it is conveyed further.

In this embodiment, the temperature of the heater 21 is controlled in the following manner. That is, the output (information of detected temperature) of the temperature detection element 21*d*, which is on the opposite surface of the substrate 21*a* from the heat generating layer 21*b*, is taken in by a temperature control circuit 25. Then, the temperature control circuit 25 controls the electric power supplied to the heater 21 with the use of an electric power supply circuit 26, based on the inputted information about the detected temperature of the heater 21. More concretely, if the heater temperature detected by the temperature detection element 21*d* is lower than a preset level, the temperature control circuit 25 controls the electrical power supply so that the heater temperature increases, whereas if the heater temperature is higher than the preset level, the temperature control circuit 25 controls the power supply so that the heater temperature decreases. That is, the temperature control circuit 25 controls the heater 21 so that the heater temperature remains roughly stable around the preset level. That is, the temperature control circuit 25, which is controlled by the control section 120, controls the electric power which is supplied to the heat generating layer 21*b* of the heater 21 from the power supply circuit 26 (controls AC voltage in phase, or in wave count).

A fixation unit of the heat-film type can use a heater having a small thermal capacity that quickly increases in temperature, as its heat generating member. For example, it can use a ceramic heater or the like as its heat generating member. Further, it can use a thin film, with a small thermal capacity, as the fixation film. Moreover, it is only the portion of the fixation film 23 that is in the fixation nip n that needs to be heated. Thus, a fixation unit of the heat-film type can quickly start up, and also, can thermally fix a toner image without consuming as much energy as a fixation unit of another type. That is, while the fixation unit of the heat-film type is on standby, its heater is not required to generate heat. Therefore, it is advantageous in that it does not use as much electrical power as a fixation unit of another type.

(3) Control Sequence

Figure 3:
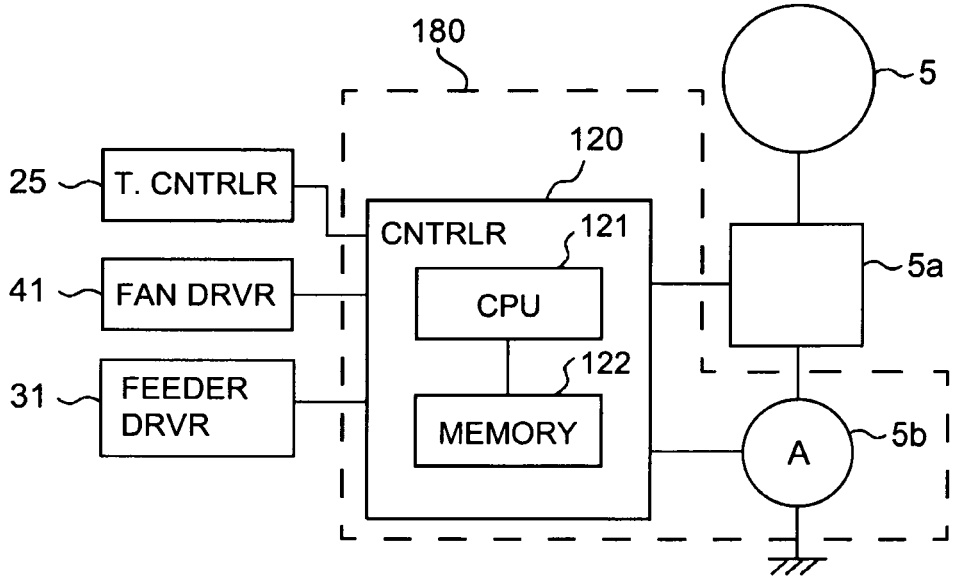
FIG. 3 is a block diagram which shows how the essential sections of the image forming apparatus are controlled.

FIG. 3 shows the control sequence for the essential portions of the image forming apparatus 100 in this embodiment. The control section 120 (engine control section), as a controlling means, with which the image forming apparatus 100 is provided, comprises: a CPU 121 as a central element that performs computational processes; and memories 122, such as a ROM, a RAM, etc., which are storage means. In the RAM, the results of the detection by the sensors, the results of computation, etc., are stored: In the ROM, control programs, data tables prepared in advance, etc., are stored. The control section 120 is connected to various sections of the image forming apparatus 100, which need to be controlled by the control section 120. In particular, in this embodiment, the control section 120 is connected to the transfer electric power source 5*a*, an ammeter 5*b* (current detecting device), a fan (F) driving circuit 41, a semi-cylindrical roller 7 for sheet feeding, a sheet feeder roller 13, etc.

In this embodiment, the control section 120 integrally controls various sections of the image forming apparatus 100. To describe more concretely with regard to this embodiment, the control section 120 controls the ATVC process, the moist paper detection process which will be described later, and a humidity removal process which also will be described later, etc.

(4) Moist Paper Detection Process

Next, the moist paper detection sequence carried out by the image forming apparatus 100 in this embodiment is described.

Hereafter, the image formation sequence which is started by a start command inputted from a host computer or the like, forms images on multiple sheets P of the recording medium, and ends as the last print is discharged (outputted) from the main assembly 110 of the image forming apparatus 100, is referred to as "printing operation (or print job)". Further, a printing operation for continuously forming images on multiple sheets P is referred to as a "continuous printing operation (or continuous printing job)". Generally speaking, a printing operation comprises: an image formation process (printing process); a pre-rotation process; sheet intervals (recording medium intervals) which occur in a case where images are formed on multiple sheets P of the recording medium; and a post-rotation process. The image formation process corresponds to a period in which an electrostatic latent image is actually formed on the photosensitive drum 1; a toner image is formed; and a toner image is transferred onto a sheet P of the recording medium. The pre-rotation process corresponds to a period in which the image forming apparatus is prepared for an actual image forming operation. The sheet interval corresponds to the interval which occurs between when a sheet P of the recording medium is conveyed through the transfer section T, and when the next sheet P is conveyed though the transfer section T, while the image formation processes are carried out in succession to form images on multiple sheets P of the recording medium. The post-rotation process corresponds to a period in which the image forming apparatus 100 is readjusted (prepared) after the completion of the image formation process.

It is based on the change in the electrical resistance of the transfer roller 5, which occurs during a printing operation, that the moist paper detection control sequence in this embodiment determines that images are being continuously formed on moist sheets of paper. Hereafter, "determining (detecting) that the recording medium on which images are being formed is a "moist sheet P of paper" may be referred to simply as "detecting moist paper".

That is, in a case where images are continuously formed on moist sheets of paper, as multiple moist sheets of paper are conveyed through the nip between the transfer roller 5 and the photosensitive drum 1, moisture adheres to the transfer roller 5. Further, as multiple moist sheets of paper are continuously conveyed through the fixation unit 16, water vapor gradually fills the internal space of the apparatus main assembly 110, and eventually adheres to the surface of the transfer roller 5. As moisture and water vapor begin to adhere to the transfer roller 5, the transfer roller 5 gradually decreases in electrical resistance. In this embodiment, this change in the electrical resistance of the transfer roller 5 is monitored to determine whether or not it is on moist sheets of paper that images are continuously formed. As described above, in this embodiment, whether or not images are being formed on moist sheets of paper is determined based on the amount of change which occurs to a value which is correlated to the electrical resistance of the transfer roller 5, which is detected by a detecting means while each sheet P of the recording medium is conveyed through the transfer nip T during a printing operation.

In this embodiment, during the pre-rotation process, a preset amount (18.0 μA) of electrical current flows from the transfer roller 5 to the photosensitive drum 1, and voltage Vtn (n >0) which is applied to flow the preset amount of electric current is obtained (ATVC sequence). Then, the electrical resistance of the transfer roller 5 is estimated from the obtained value of the voltage Vtn (n >0). That is, the control section 120 applies voltage to the transfer roller 5 from the transfer electric power source 5*a* while detecting the electric current which flows from the transfer roller 5 with the use of the ammeter 5*b*, and controlling the transfer electric power source 5*a* in output (voltage) so that the detected amount of the electric current converges to a preset value, and obtains the amount of voltage necessary to cause electric current to flow from the transfer roller 5 to the photosensitive drum 1 by a preset amount (value). In this embodiment, the control section 120 and the ammeter 5*b* make up the detection unit 180 which detects the value which has a correlation with the amount of water vapor in the apparatus main assembly 110. In this embodiment, this detection unit 180 detects the amount of voltage which needs to be applied by a voltage applying means to the transferring member to make a preset amount of electric current flow from the transfer roller 5.

In this embodiment, the definition of the above-described value of voltage Vtn (n >0) is as follows. The amount of voltage obtained during the pre-rotation process in a printing operation is Vt0. Vtn (n >1) stands for the voltage obtained during the sheet interval which occurs immediately after the formation of the n-th print. As described above, the sheet interval means the interval between two sheets P of the recording medium which are successively conveyed in a printing operation. That is, it corresponds to a period in which no sheet P of the recording medium is in the transfer nip T. There is a tendency that the lower the transfer roller 5 in electrical resistance, the smaller the value of the voltage Vtn.

Figure 4:
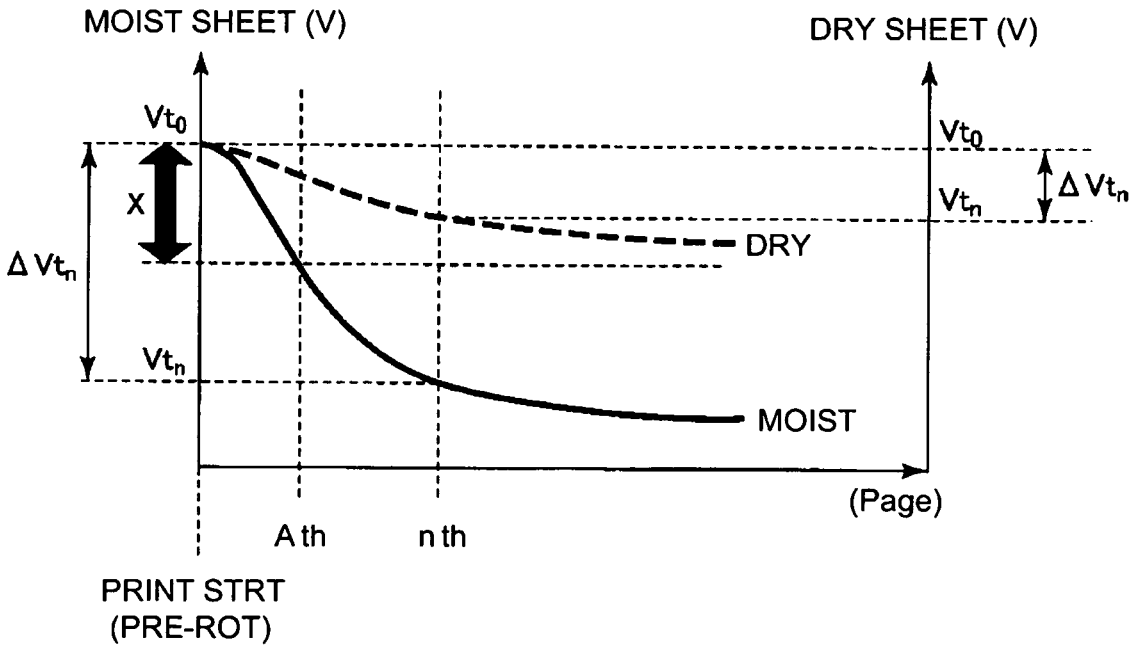
FIG. 4 is a graph which shows an example of a change which occurs to the electrical resistance of the transfer roller while images are continuously formed on a substantial number of sheets of moist sheets of paper, and a substantial number of dry sheets of paper.

FIG. 4 shows the changes which occurred to the electrical resistance of the transfer roller 5 when a continuous printing operation was carried out with the use of moist sheets of paper, and also, with the use of dry sheets of paper. The horizontal axis represents print counts, and the vertical axis presents the amount of voltage Vtn (n≥0), based on which the electrical resistance of the transfer roller 5 was estimated.

It is evident from FIG. 4 that during a continuous printing operation, as the print count increased, the voltage Vtn (n ≥0) decreased in value. This means the following. As the printing operation continued, the transfer roller 5 absorbed moisture. Consequently, new electric current paths were created in the transfer roller 5, whereby the electrical resistance of the transfer roller 5 decreased. During a printing operation, as moist sheets of paper were conveyed between the transfer roller 5 and the photosensitive drum 1, moisture adhered to the peripheral surface of the transfer roller 5, and/or the water vapor which was generated as moist sheets of paper were conveyed through the fixation unit 16 adhered to the peripheral surface of the transfer roller 5. Consequently, the transfer roller 5 absorbed moisture. Further, it is evident from FIG. 4 that a printing operation in which moist sheets of paper are used is greater in the amount by which the voltage Vtn (n ≥0) decreases than a printing operation in which dry sheets of paper are used. This means that a printing operation in which moist sheets of paper were used generated a greater amount of water vapor, and therefore, the transfer roller 5 decreased in electrical resistance by a greater amount, than a printing operation in which dry sheets of paper were used.

In this embodiment, the control section 120 carries out computations to compare the voltage Vt0 obtained during the pre-rotation process in a printing operation, and voltage Vtn (n ≥0) obtained during each paper interval during the printing operation. Then, as the difference ΔVtn between the voltage Vt0 and voltage Vtn (n ≥0), that is, the amount by which voltage changed from voltage Vt0 to voltage Vnt, exceeds a preset threshold value, the control section 120 determines that images are being formed on moist sheets of paper. That the difference ΔVtn has a positive value means that the voltage Vtn (n ≥0) became smaller than the voltage Vt0, that is, the electrical resistance of the transfer roller 5 has changed in the direction to decrease. In this embodiment, the threshold value X for the difference ΔVtn was preset to Δ80 V in advance. Thus, in an actual printing operation, it was when the value of the difference ΔVtn exceeded Δ80 V for the first time, that is, when the A-th print was made, that it was determined that images were being formed on moist sheets of paper. By the way, in this embodiment, the value for the threshold X was set so that no matter how many images were continuously formed on moist sheets of paper, the difference ΔVtn did not exceed the threshold X. Further, in this embodiment, it is based on the amount of change (that is, difference ΔVtn) which occurred to the voltage Vtn (n ≥0) that the control section 120 carries out the moisture removal sequence for reducing the amount of the water vapor which is generated as a sheet P of the recording paper is heated by the fixation unit 16. In particular, in this embodiment, if the control section 120 determines, based on the difference ΔVtn, that images are being formed on moist sheets of paper, it immediately makes an adjustment so that the temperature setting of the fixation unit 16 is reduced, while continuing the printing operation. That is, it reduces the amount of water vapor generated from a sheet P of the recording paper, by reducing the heating temperature of the fixation unit 16.

As described above, in this embodiment, the control section 120 obtains the amount of change which occurred to the value detected by the detecting means after the transferring process is started in a printing operation, from the value detected by the detection unit 180 before the transfer process is started in the printing operation. Then, as the amount of this change exceeds the preset threshold value in terms of the direction in which the electrical resistance of the transfer roller 5 decreases, the control section 120 makes the image forming apparatus 100 carry out the moisture removal sequence. The difference ΔVtn is an example of factor which has a correlation with the electrical resistance of the transfer roller 5, which is detected by the detection unit 180.

The moisture removal sequence does not need to be limited to such a sequence as the above-described one which adjusts the temperature setting of the fixation unit 16. For example, as the moisture removal sequence for reducing the amount of water vapor generated, the sheet feeding control may be adjusted to widen the image forming apparatus 100 in the sheet conveyance interval (paper interval) with which sheets P of the recording medium are continuously conveyed to the transfer nip T. The above-described amount of water vapor generated can be reduced by carrying out at least one of the two adjustments, that is, the adjustment of the fixation temperature of the fixation unit 16, and the adjustment of the recording medium conveyance control (sequence). Further, the moisture removal control does not need to be limited to the above-described control which reduces the amount of water vapor generated. That is, it may be such a control that reduces the amount of water vapor generated by the heating of sheets P of the recording paper by the fixation unit 16. For example, in order to increase the efficiency with which the water vapor in the apparatus main assembly 110 is exhausted, the control for the rotation of the fan F may be adjusted. That is, the amount of the above-described water vapor in the apparatus main assembly 110 can be reduced by changing the revolution of the fan F, which either draws air into the apparatus main assembly 110 from outside the apparatus main assembly 110, or exhausts air from within the apparatus main assembly 110. "Changing the revolution of the fan F" includes "changing the fan F state from being stationary to rotating, and also, changing the revolution of the fan F from the first revolution to the second revolution, which is greater than the first one. As described above, the moisture removal control has only to be such a control that can prevent the amount of the water vapor in the apparatus main assembly 110 (more precisely, within the recording medium conveyance passage) from exceeding a preset value.

By the way, it is desired that the above-described adjustments as the moisture removal control are continued until the on-going printing operation is completed. They may be continued until the operation of the image forming apparatus 100 stops. Further, the above-described adjustments of various controls as the moisture removal controls can be carried out in a combination of two more controls.

Figure 5:
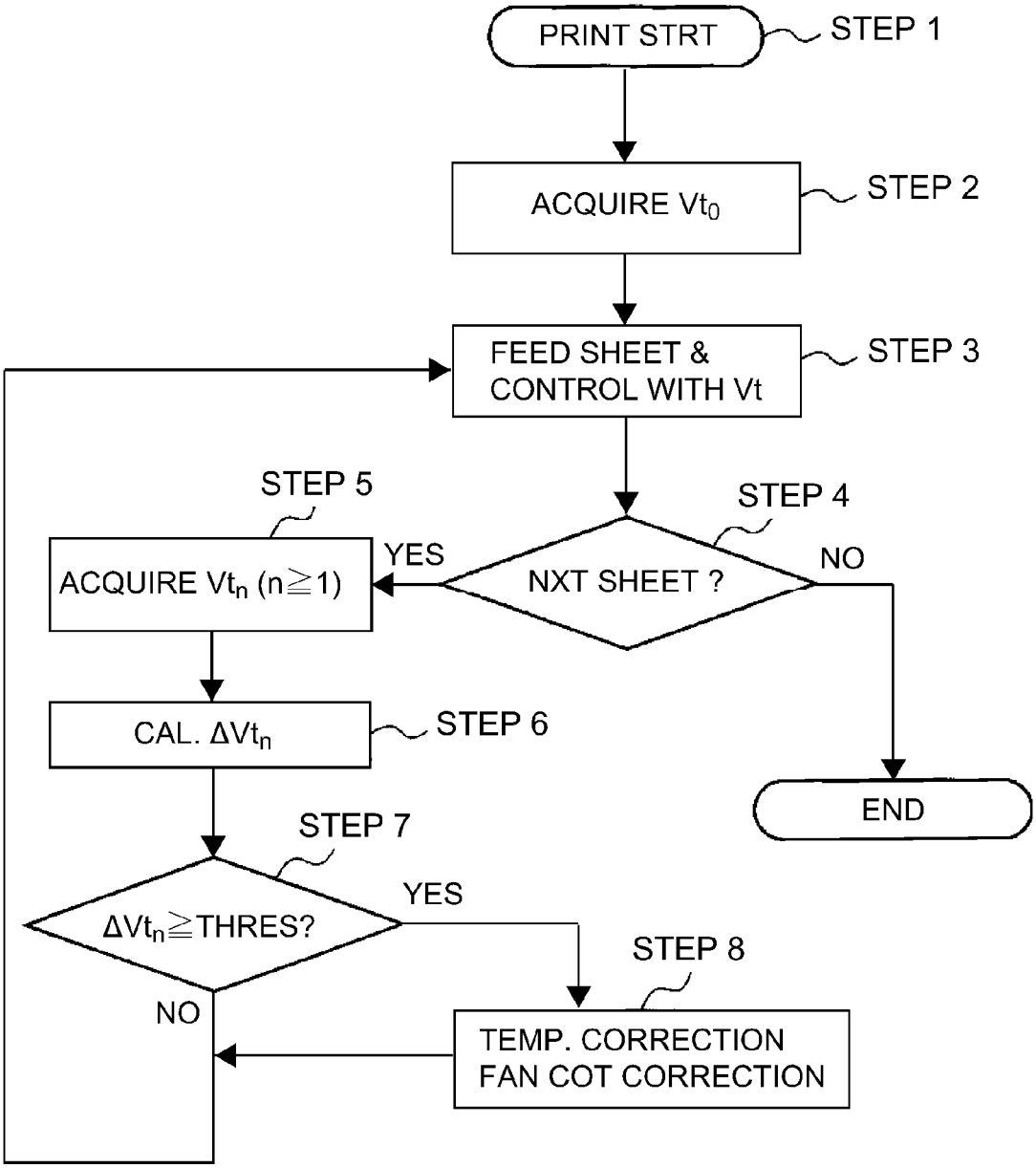
FIG. 5 is a flowchart of a combination of the control sequence for detecting a sheet of moist paper, and control sequence for removing moisture.

FIG. 5 is a simplified version of the flowchart of the moist sheet detection control sequence and the moisture removal control sequence.

As a printing operation is started (Step 1), the control section 120 obtains the value of the voltage Vt0 by carrying out the ATVC sequence for estimating the electrical resistance of the transfer roller 5 after the elapse of a preset length of time after it begins to drive the driving system (Step 2). Then, as the leading edge of the sheet P of the recording paper is detected, the control section 120 makes the image forming apparatus 100 start the toner image formation, and conveys the sheet P to the transfer nip T, and applies the voltage VT to electrostatically transfer the toner image (Step 3). This voltage VT is the transfer voltage, which is estimated based on the voltage Vtn (n ≥n). Next, the control section 120 checks whether or not there remains the image formation process for forming an image on the following sheet P of the recording paper (Step 4). If it is determined in Step 4 that there is not an image formation process for the following sheet P, it ends the printing operation.

On the other hand, if the control section 120 determines, in Step 4, that there is an image formation process for the following sheet P, the control section 120 carries out the ATVC sequence for the second time to obtain the voltage Vtn (n ≥0), after the trailing edge of the immediately preceding sheet P comes out of the transfer nip T. (Step 5). Then, the control section 120 calculates the difference ΔVtn, which is obtainable by subtracting the value of the voltage Vtn (n ≥0) in Step 5 from the value of the voltage Vt0 obtained in Step 2 (Step 6). Next, the control section 120 checks whether or not the value of the difference ΔVtn is no less than the threshold value X (Step 7). If the control section 120 determines that the difference ΔVtn is no less than the threshold value X, it lowers the temperature setting for the fixation unit 16 (Step 8). However, the control sequence may be such that not only the fixation unit 16 is adjusted in temperature setting, but also, the revolution of the fan F is adjusted, or only the revolution of the fan F is adjusted, instead of adjusting the temperature setting of the fixation unit 16. Further, if the control section 120 determines that the value of the difference ΔVtn is no more than the threshold value X, it continues the printing operation without making the above-described adjustments.

Thereafter, the control section 120 goes back to Step 3 and Step 4. Then, it sequentially repeats Steps 5 - 8 until it determines that no sheet P of the recording paper is following. Lastly, as it determines in Step 4 that no sheet P of the recording paper is following, it ends the printing operation.

By the way, in this embodiment, it is during each paper interval in a printing operation that the ATVC sequence is carried out to obtain the value of the voltage Vtn (n ≥0). However, it may be during every preset number of paper intervals (every other paper interval, for example) that the ATVC sequence is carried out to obtain the value of the voltage Vtn (n≥1).

(5) Verification of effects of this embodiment

Next, the experiments carried out to verify the effects of the control in this embodiment are described. The contents of the experiments are as follows. 500 prints were continuously made with the use of moist sheets of paper which were roughly 10% in water content, in an environment which was normal in temperature and humidity, while measuring the amount of water droplets which resulted from the condensation of the water vapor in the sheet passage 18 (post-fixation sheet conveyance passage) which is typical of the sheet conveyance passages of the image forming apparatus 100. By the way, the moist sheets of paper which were roughly 10% in water content were recycled sheets of paper, which were more likely to absorb moisture than unused sheets of paper. They were left no less than 48 hours in an environment which was high in temperature and humidity. The transfer roller 5 used in these experiments was 50 MΩin electrical resistance. The threshold value X for the difference ΔVtn was set to Δ80 V. The amount of the moisture in the sheet passage 18 condensed into water droplets was calculated from the change which occurred to the weight of the sheet passage 18 between before a printing operation was started, and after the printing operation was ended. Further, in the case of the control sequence in this embodiment, it was determined while the 50th print was being made during a continuous printing operation, that an image was being formed on a moist sheet of paper, and the temperature setting of the fixation unit 16 was lowered in to make the 51st print and thereafter. Further, the fan F, which was kept stationary, was started. By the way, although in this embodiment, the fan F, which was kept stationary was started, the control may be such that the fan F, which was rotated at a relatively low speed, is switched in speed to a relatively higher one.

As a result, the amount of water droplets generated when the control sequence in this embodiment was used was no more than ⅕ of the amount of water droplets generated when the comparative control sequence was used. Further, it was confirmed that the control sequence in this embodiment can prevent the unsatisfactory sheet conveyance, which results in the bending of the corners of a sheet P of the recording medium, and/or wrinkling of the sheet.

As described above, according to this embodiment, whether or not images are being formed on moist sheets of the recording paper, that is, sheets of paper which are relatively high in water content, is determined based on the change in electrical resistance which occurs to the transfer roller 5 during a printing operation. As for the electrical resistance of the transfer roller 5, it is measured while no sheet P of the recording paper is in the transfer nip T before a printing operation is started and during the printing operation. Therefore, it is possible to determine whether or not images are being formed on moist sheets of recording paper, without being affected by the recording-medium type, and the amount of toner in a toner image. Further, the result of this detection is fed back to the temperature control of the fixation unit 16, and/or control of the revolution of the fan F. Therefore, it is possible to prevent such unsatisfactory recording medium conveyance that is likely to cause a sheet P of the recording medium (paper) to bend at a corner (corners), and/or to wrinkle, in case where a large number of images are continuously formed with the use of moist sheets of paper.

Embodiment 2

Next, another embodiment of the present invention is described. The image forming apparatus 100 in this embodiment is the same in basic structure and operation as the image forming apparatus 100 in the first embodiment. Therefore, the components of the image forming apparatus 100 in this embodiment, which are the same as, or equivalent to, the counterparts in the first embodiment, in function and structure, are given the same reference characters as the counter parts, and are not described in detail.

This embodiment is characterized in that the threshold value X for the difference ΔVtn is adjusted according to the electrical resistance (which hereafter may be referred to as initial electrical resistance) of the pressure roller 24 measured before a printing operation is started (more precisely, during pre-rotation process).

Figure 6:
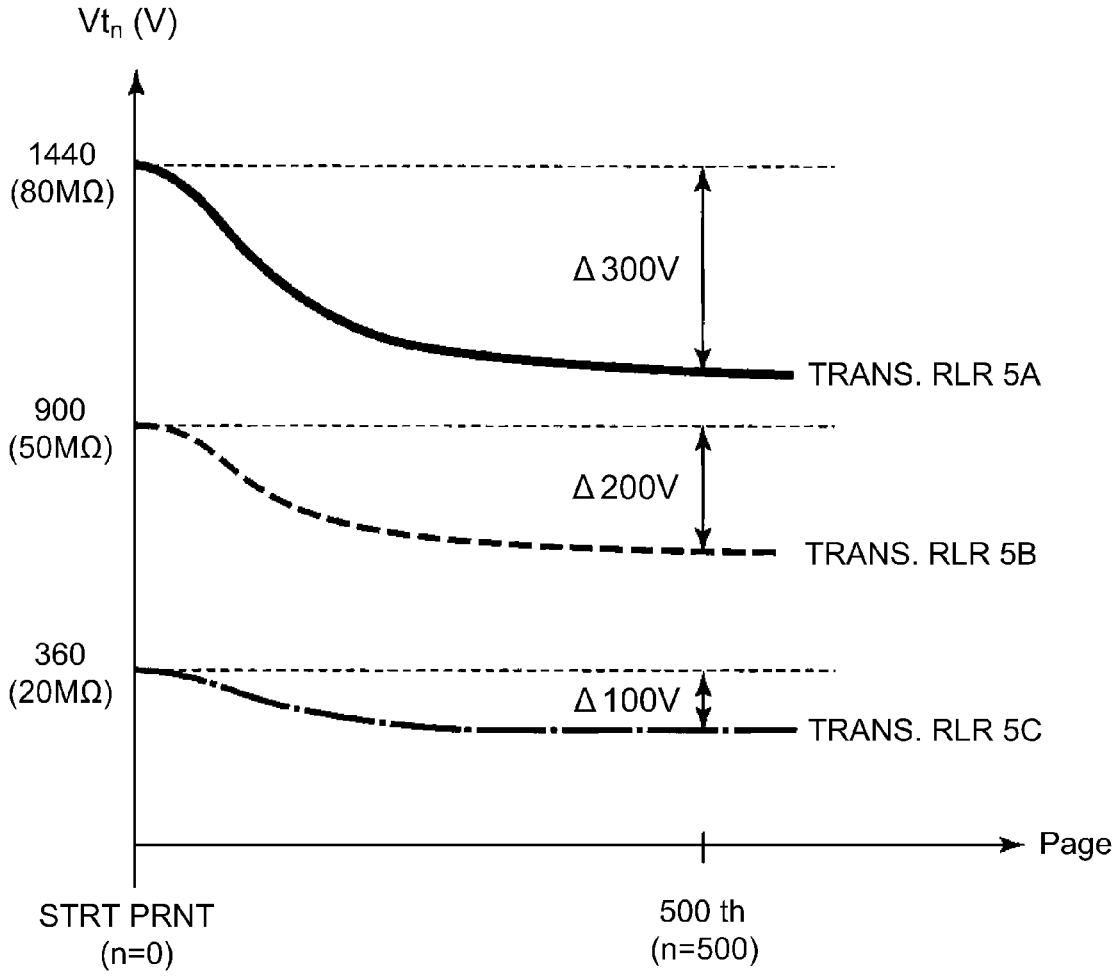
FIG. 6 is a graph which shows another example of a change which occurs to the electrical resistance of the transfer roller while images are continuously formed on a substantial number of sheets of a recording medium.

FIG. 6 shows the changes which occurred to the electrical resistance of the transfer roller 5 while 500 prints were continuously made on moist sheets of paper, which were roughly 10% in water content, with the use of transfer rollers 5 which are different in initial electrical resistance, in an environment which is normal in temperature and humidity. The horizontal axis represents print counts, and the vertical axis presents voltage Vtn (n≥0), based on which the electrical resistance of the transfer roller 5 was estimated. Transfer rollers 5A, 5B and 5C are 80 MΩ, 50 MΩ and 20 MΩ, respectively, in initial electrical resistance. Further, in terms of voltage Vt0, which corresponds to initial electrical resistance, they are 1440 V, 900 V and 360 V, respectively.

Figure 7:
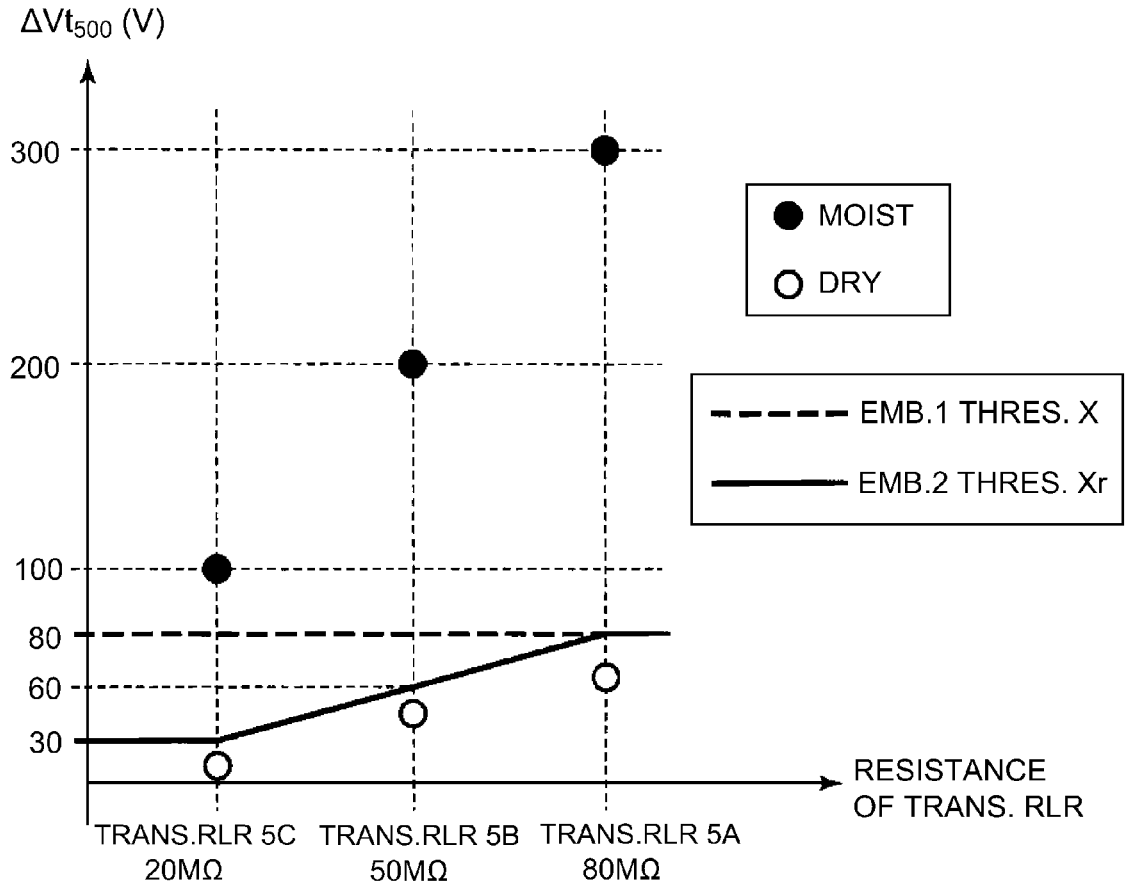
FIG. 7 is a graph for illustrating the threshold voltage for the moist paper detection control.
Figure 8:
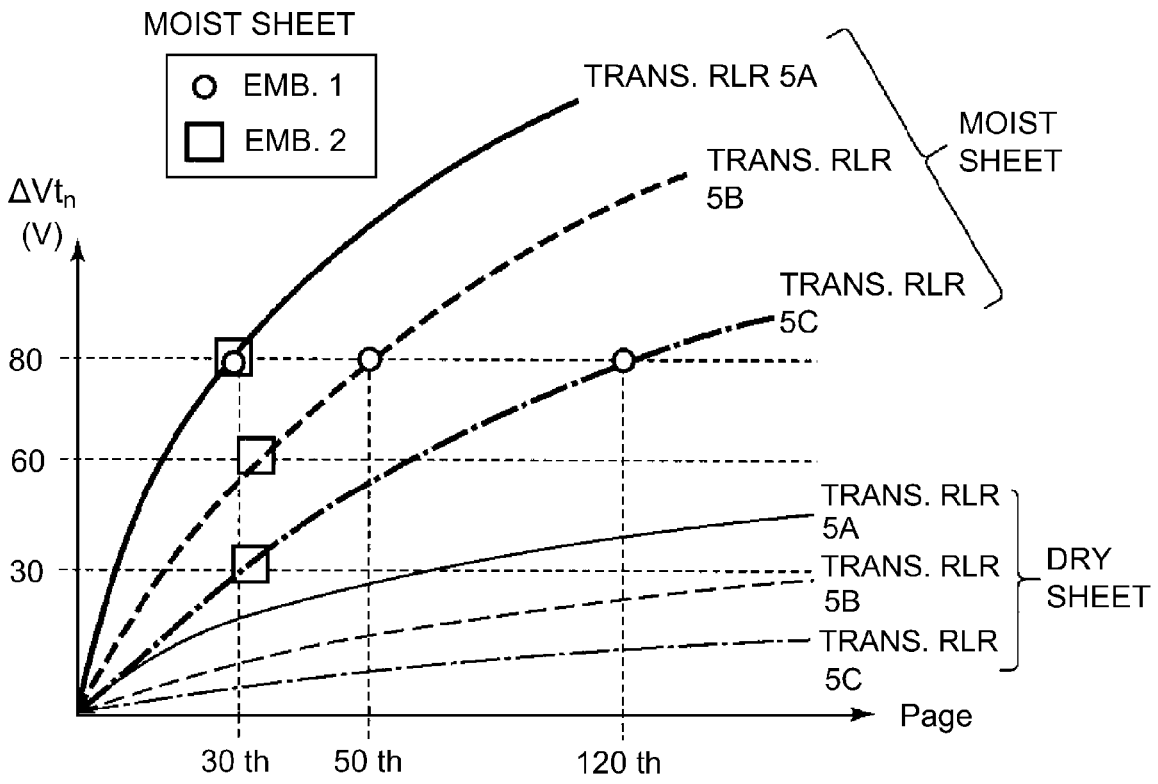
FIG. 8 is a graph which shows another example of a change which occurs to the electrical resistance of the transfer roller while images are continuously formed on a substantial number of sheets of the recording medium.

It is evident from FIG. 6 that the higher in initial electrical resistance a transfer roller, the more likely it is to decrease in electrical resistance during a printing operation. For example, in terms of the amount ΔVt500 by which the three transfer rollers 5 changed in electrical resistance while 500 prints were continuously made, the transfer roller 5A, which is highest in initial electrical resistance, decreased in electrical resistance by Δ300 V, and the transfer roller 5B decreased in electrical resistance by Δ200 V. Further, the transfer roller 5C, which is lowest in initial electrical resistance, decreased in electrical resistance by Δ100 V. As described above, the reason why the transfer roller 5 decreases in electrical resistance during a printing operation in which images are formed on moist sheets of paper is that as the printing operation continues, the transfer roller 5 absorbs moisture, and therefore, new electrical current paths are formed in the transfer roller 5. During a printing operation which uses moist sheets of paper as recording medium, as each moist sheet of paper moves between the transfer roller 5 and the photosensitive drum 1, moisture adheres to the peripheral surface of the transfer roller 5. Further, as a moist sheet of paper is moved through the fixation unit 16, the water vapor which is generated from the sheet adheres to the peripheral surface of the pressure roller 24. Consequently, the transfer roller 5 absorbs moisture. By the way, the number of new electrical current paths which are formed in the transfer roller 5 during a printing operation remains the same, regardless of the amount of initial electrical resistance of the transfer roller 5. However, the higher in initial electrical resistance a transfer roller, the smaller the number of preexisting electrical current paths in the transfer roller. Thus, it seems reasonable to think that the higher a transfer roller 5 in initial electrical resistance, the greater the increase in the number of electrical current paths of the transfer roller 5, and therefore, the more likely to decrease in electrical resistance. FIG. 7 shows the amount ΔVt500 of change which occurred to the electrical resistance of the transfer roller 5 when 500 prints were continuously made on moist sheets of paper, which are roughly 10% in water content, and 500 dry sheets of paper, which were roughly 5% in water content, with the use of transfer rollers 5 which were different in initial electrical resistance, in an environment which was normal in temperature and humidity. By the way, immediately after 500 prints are made, the transfer rollers 5 will have been reduced in electrical resistance as much as they can be. Therefore, even if additional prints are made, the amount of change, which occurs to the electrical resistivity of the transfer rollers 5, does not exceed ΔVt500. In the first embodiment, the threshold value X for the difference ΔVtn was set to Δ80 V in advance (broken line in FIG. 7). Further, as it is detected for the first time (A-th sheet) in an actual printing operation that the value of the difference ΔVtn is no less than 80 V, it is determined that images are being formed on moist sheets of paper. In comparison, in this embodiment, the threshold X for the difference ΔVtn is changed in value according to the initial electrical resistance of the transfer roller 5 (solid line in FIG. 7). The lower the transfer roller 5 in initial electrical resistance, the smaller the amount ΔVt500 of change in the electrical resistance of the transfer roller 5 during a printing operation. Therefore, the threshold X is set to be smaller in value. The results of the setting are described later. More concretely, in the case of the transfer roller 5A, which is 80 MΩin initial electrical resistance, the threshold value Xr is set to Δ80 V, and in the case of the transfer roller 5B, which is 50 MΩin initial electrical resistance, the threshold value Xr is set to Δ60 V. In the case of the transfer roller 5C which is 20 MΩ in initial electrical resistance, the threshold value Xr is set to Δ30 V. Further, the threshold value X is continuously changed in a range of 20 MΩ- 80 MΩ. FIG. 8 shows the change in the amount of electrical resistance ΔVtn of the transfer roller 5 when prints were continuously made with the use of moist sheets of paper which are roughly 10% in water content, and dry sheets of paper which were roughly 5% in water content, in an environment which was normal in temperature and humidity. With reference to FIGS. 7 and 8, this embodiment is described in comparison to the first embodiment, regarding the ordinal number of the moist sheet of paper which is being conveyed through the transfer nip T when it is determined that an image is being formed on a moist sheet of paper. Referring to FIG. 8, in the first embodiment, the threshold value X for the difference ΔVtn is set to Δ80 V. Therefore, in the case of the transfer roller 5A, which is highest in electrical resistance, as the 30th print was made, it was determined that an image was being formed on a moist sheet of paper. In the case of the transfer roller 5B, as the 50th print was made, it was determined that an image was being formed on a moist sheet of paper. Further, in the case of the transfer roller 5C which is lowest in electrical resistance, it was when an image was being formed on the 120th sheet of paper that it was determined that an image was being made on a moist sheet of paper. In addition, in this embodiment, the threshold value X for the difference ΔVtn was adjusted according to the initial electrical resistance of the transfer roller 5. Therefore, whether the transfer roller 5 used for a printing operation is the transfer roller 5A, which is highest in initial electrical resistance, the transfer roller 5B, or the transfer roller 5C, which is lowest in initial electrical resistance, it was possible to determine, when an image was formed on roughly the 30th sheet of paper, that the sheet of paper on which an image was being formed was a moist sheet of paper. That is, in comparison to the first embodiment, whether or not an image is being formed on a moist sheet of paper can be detected while the print count is less than in the first embodiment. Being able to detect whether or not an image is being formed on a moist sheet of paper while print count is relatively small results in the reduction in the sweating of the recording medium passage, which in turn makes it possible to reliably reduce the frequency with which the unsatisfactory sheet conveyance, which will result in the bending of corners of a sheet P of the recording paper, and/or wrinkling of the sheet P, occurs.

As described above, according to this embodiment, it is possible to precisely detect a sheet of paper which is relatively high in water content at a proper point in time, and therefore, to more reliably prevent the unsatisfactory sheet conveyance which results in the bending of the corners of a sheet P of the recording paper, and or wrinkling of the sheet P.

[Embodiment 3]

Next, another embodiment of the present invention is described. The basic structure and operation of the image forming apparatus 100 in this embodiment are the same as those of the image forming apparatus 100 in the first embodiment. Therefore, the components of the image forming apparatus in this embodiment, which are the same as, or similar to, the counterparts in the first embodiment, in terms of function and operation, are given the same reference characters as the counterparts, and are not described in detail.

This embodiment is characterized in that the threshold value X for the difference ΔVtn is adjusted according to the water content of the transfer roller 5 measured before a printing operation is started (more precisely, during pre-rotation process in printing operation).

Whether the transfer roller 5 is relatively high or low in water content prior to the starting of a printing operation significantly affects the change which occurs to the electrical resistance of the transfer roller 5 during the sampling of the electrical resistance of the transfer roller 5, which follows the starting of the printing operation. The reason for the occurrence of this phenomenon is described later.

Thus, in this embodiment, it is determined whether the transfer roller 5 is relatively high or low in water content prior to the starting of a printing operation. Then, the threshold value X for detecting whether or not an image is being formed on a moist sheet of paper is set according to the result of the determination. Whether the transfer roller 5 is relatively high or low in water content prior to the starting of a printing operation can be determined based on the history of the image forming apparatus 100 which concerns the immediately, or several, preceding printing operations carried out by the image forming apparatus 100. For example, in a case where there is a history that moist sheets of paper were detected in the immediately, or several, preceding printing operations, the water content of the transfer roller 5 can be estimated with the use of the following method. That is, the water content of the transfer roller 5 can be estimated based on at least one of the historical information, that is, the image output count (that is, number of images formed on moist sheets of paper), and the length of time which has elapsed after the ending of the preceding printing operation. In this embodiment, the control section 120 can obtain the above-described historical information from the points in time at which one of the preceding printing operations was started and ended, and the number of sheets of the recording paper (image output count) used for the printing operation. This historical information has been sequentially stored in the memory 122.

Thus, if it is determined that the transfer roller 5 is satisfactorily dry, whether or not the transfer roller 5 is relatively high in water content can be detected with the use of the threshold values X in FIG. 7. On the other hand, if it is determined that the transfer roller 5 is relatively high in water content, whether or not a sheet P of paper is high in water content is determined with the use of threshold value Xs shown in FIG. 10. Further, if it is determined that the transfer roller 5 is in the mid-range in terms of water content, the threshold value X is set in a range Y in which the threshold value X can be changed between the threshold values Xr and Xs to properly deal with the moisture. It is also feasible to select one of the threshold values Xr and Xs. Further, one of the threshold values X shown in FIG. 7 may be used instead of the threshold value Xr, if it is desired.

Figure 11:
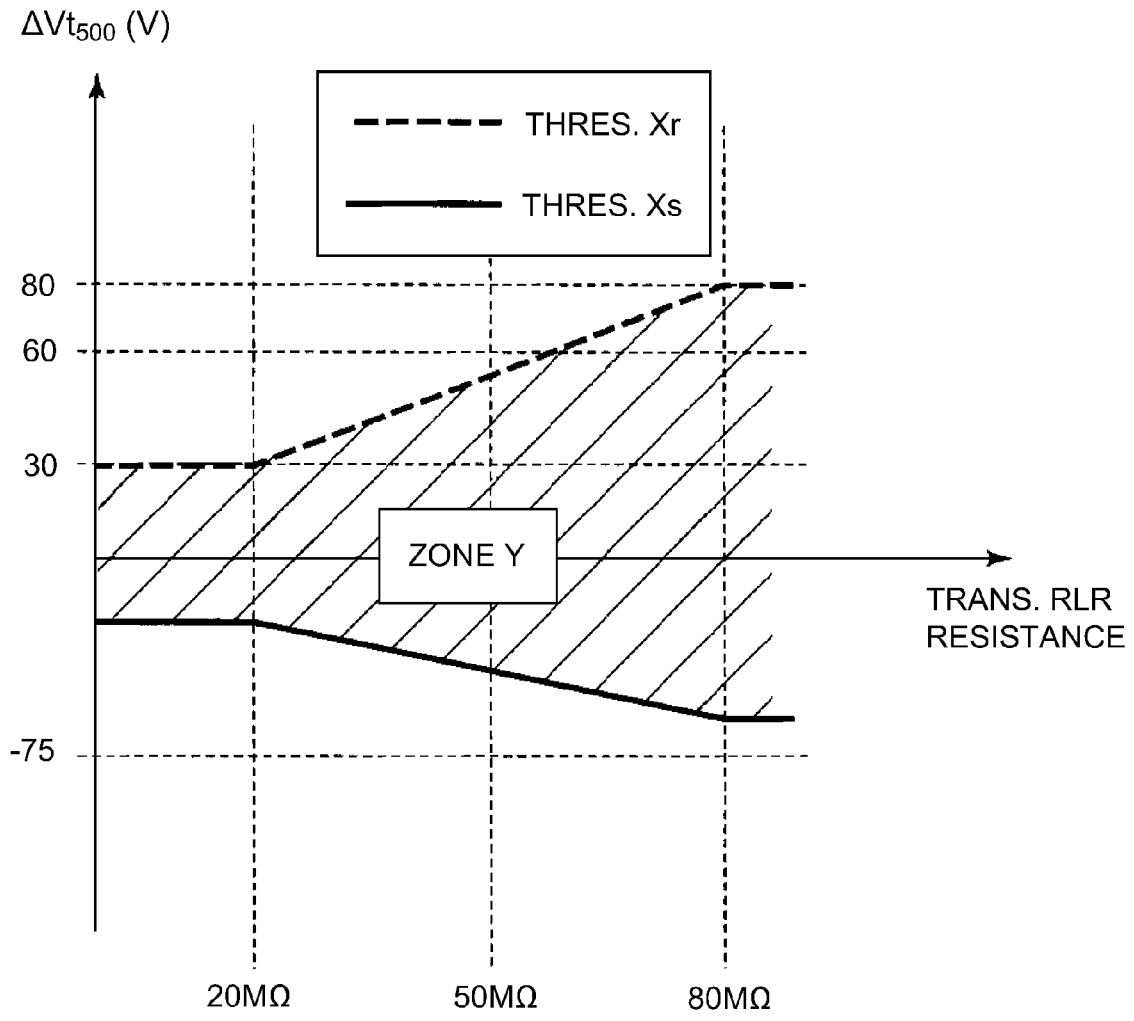
FIG. 11 is a graph for illustrating the range of the threshold voltage for the moist paper detection control.

Referring to FIG. 11, in this embodiment, if it is determined that the transfer roller 5 is relatively high in water content, the threshold X is set to a value which is smaller than the value to which it is set if it is determined that the transfer roller 5 is relatively low in water content (Xr>Xs), as will be described later in detail. Further, if it is determined that the transfer roller 5 is relatively high in water content, the value for the threshold X is set in such a manner that the smaller the transfer roller 5 in initial electrical resistance, the greater the threshold X. If the number of sheets P used in a printing operation in which moist sheets of paper are used is no less than a preset value, if the length of time having elapsed since the ending of the printing operation is no less than a preset value, or if both of the preceding conditions are met, it may be determined that the water content of the transfer roller 5 is higher than a preset value. Regarding one of two or more preceding printing operations, it may be any of the preceding printing operations, except for the immediately preceding one. It may be selected according to how easily the transfer roller 5 absorbs moisture, or the like factor. For example, it may be one of roughly ten of preceding printing operations. As for the preset value for the sheet count, it may be 500 sheets, for example, which is not mandatory. As for the preset value for the length of elapsed time, it may be four hours, for example. For example, in a case where the number of sheets P of paper used in one of the preceding printing operations in moist sheets of paper were detected was no less than 500, and, and the length of time having elapsed after the ending of this printing operation is no more than four hours, it may be determined that the transfer roller 5 is as moist as it can be. Further, the cumulative number of sheets P of paper used in the two or more preceding printing operations in which moist sheets of paper were used, and the length of time having elapsed after the ending of the last of two or more preceding operations, etc., may be used as the historical information.

Figure 9:
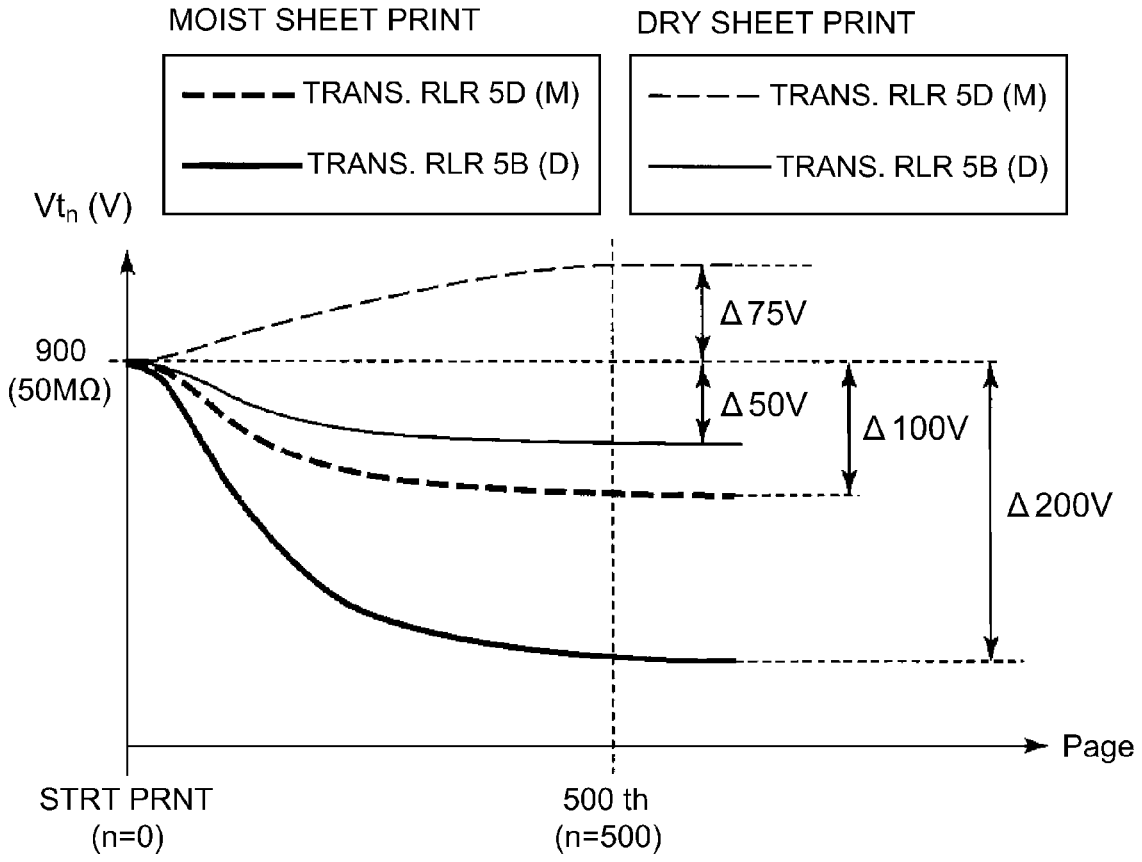
FIG. 9 is a graph which shows another example of a change which occurs to the electrical resistance of the transfer roller while images are continuously formed on a substantial number of sheets of the recording medium.

FIG. 9 shows the change which occurred to the electrical resistance of the transfer roller 5 when transfer rollers 5D and 5B which are different in the length of time having elapsed after the ending of the preceding printing operation were used. To describe in greater detail, FIG. 9 shows the change which occurred to the electrical resistance of the transfer rollers 5D and 5B when 500 prints were continuously made with the use of moist sheets of paper which were roughly 10% in water content, and dry sheets of paper which were roughly 5% in water content. The horizontal axis represents print counts, and the vertical axis presents voltage Vtn (n≥0), based on which the electrical resistance of the transfer rollers 5D and that of the transfer roller 5B, were estimated. Transfer rollers 5D and 5B were both 50 MΩ in initial electrical resistance. However, the transfer roller 5D was tested immediately after a large number of images were formed on moist sheets of paper. Therefore, its surface was damp. On the other hand, the transfer roller 5B was tested no less than four hours after a large number of images were formed on moist sheets of paper in the preceding printing operation. Therefore, its surface is significantly drier in comparison to the transfer roller 5D.

It is evident from FIG. 9 that in a printing operation in which moist sheets of paper were used as the recording medium, the transfer roller 5D, the surface of which is damp, is less likely to decrease in electrical resistance than the transfer roller 5B. For example, regarding the amount ΔVt500 by which the transfer rollers 5D and 5B decrease in electrical resistance when 500 prints were continuously made, the transfer roller 5B which was relatively dry decreased in electrical resistance by Δ200 V, whereas the transfer roller 5D, which was damp, decreased in electrical resistance by only Δ100 V. As described above, the reason why the transfer roller 5 decreases in electrical resistance in a printing operation in which moist sheets of paper are printed, is that as a moist sheet of paper moves between the transfer roller 5 and the photosensitive drum 1, and/or fixation unit 16, the transfer roller 5 absorbs moisture, and therefore, new electrical current paths are formed. However, the adhesion of the moisture to the transfer roller 5 is more likely to noticeably occur when the surface of the transfer roller 5 is dry than otherwise. Therefore, if a printing operation in which moist sheets of paper are used as the recording medium is started when the surface of the transfer roller 5 is already damp like the transfer roller 5D, the amount by which moisture adheres to the transfer roller 5 is very small, and therefore, the transfer roller 5 is unlikely to substantially decrease in electrical resistance.

Figure 10:
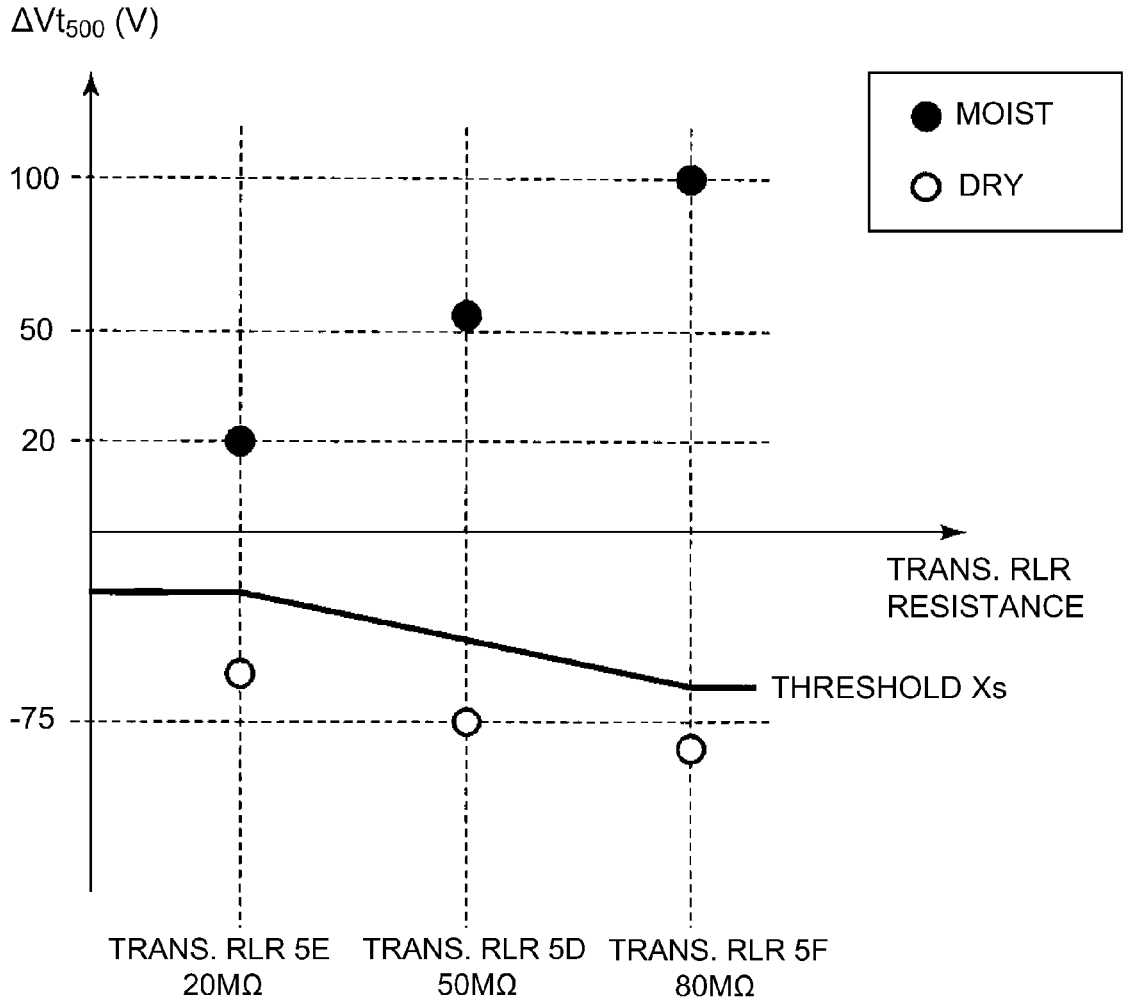
FIG. 10 is a graph for illustrating another example of the threshold voltage for the moist paper detection control.

It is also evident from FIG. 9 that in a printing operation in which dry sheets of paper are used as the recording medium, the damp transfer roller 5D increases in electrical resistance rather than decreases. This occurs because as moist sheets P of paper are continuously moved in contact with the transfer roller 5, the moisture in the transfer roller 5 is gradually absorbed by the sheets P. FIG. 10 shows the amount ΔVt500 of change which occurred to the electrical resistance of the transfer roller 5 while 500 prints were continuously made on moist sheets of paper which were roughly 10% in water content, and 500 relatively dry sheets of paper which were roughly 5% in water content, with the use of transfer rollers 5D, 5E and 5F which were relatively high in water content, in an environment which was normal in temperature and humidity. The transfer rollers 5D, 5E and 5F are different in initial electrical resistance, being 50 MΩ, 20 MΩand 80 MΩ), respectively. Further, as described above, the difference ΔVtn is the difference between the voltage Vt0 which is obtained during the pre-rotation process of a printing operation, and the voltage Vtn (n ≥0) which is calculated during each paper interval in the printing operation. Thus, if the value of the ΔVt500 is negative in a printing operation in which recording media are relatively dry sheets of paper, it means that the value of the voltage Vt500 after the production of 500 prints is greater than the value of the voltage Vt0 obtained during the pre-rotation process. This means that the transfer roller 5 was increased in electrical resistance by the printing operation. The reason why the transfer roller 5 increased in electrical resistance is as described previously. Further, the higher the transfer roller 5 in initial electrical resistance, the smaller the transfer roller 5 in the number of preexisting electrical current paths, and therefore, the greater the amount by which the transfer roller 5 increases in electrical resistance as the moisture in the transfer roller 5 is lost by being absorbed by the relatively dry sheets of paper. Therefore, if it is determined that the transfer roller 5 is damp, whether or not recording media are moist sheets of paper is detected with the use of threshold value Xs, in consideration of the above-described likelihood.

As described above, according to this embodiment, even if the transfer roller 5 does not remain the same in the amount of water content measured at the beginning of a printing operation, it is possible to accurately detect whether or not moist sheets of paper are being used for image formation. Therefore, even if a given image forming apparatus has been used in various conditions which were substantially different in temperature and humidity, it is still possible to reduce the frequency with which unsatisfactory sheet conveyance, which will possibly cause a sheet of paper to bend at a corner (or corners), and/or wrinkle, occurs.

[Miscellanies]

In the foregoing, the present invention was described with reference to concrete embodiments of the present invention. However, the preceding embodiments are not intended to limit the present invention in scope.

For example, in the above-described embodiments, the information related to the internal humidity (amount of moisture) of the main assembly of the image forming apparatus was obtained from the change which occurred to the electrical resistance of the transfer roller. However, the information related to the internal humidity of the apparatus main assembly may be directly obtained by placing a humidity sensor, as a means for directly obtaining the information related to the internal humidity of the apparatus main assembly, in the apparatus main assembly, so that whether or not images are formed on moist sheets of paper can be detected based on the change in the internal humidity of the apparatus main assembly, based on the similar principle to that in the preceding embodiments.

Further, in the preceding embodiments, as it was detected that images are being formed on moist sheet of paper, this information was fed back to the control section to adjust the fixation unit in temperature setting, and/or adjust the fan control. However, these embodiments are not intended to limit the present invention in scope. For example, the information may be fed back to the control section to adjust in value the voltages to be applied to the transfer section and fixation section to improve an image forming apparatus in terms of the level of quality with which images are formed on a moist sheet of paper. For example, if it is detected that an image is being formed on a moist sheet of paper, at least one of the voltage which is to be applied to the transferring member and the voltage to be applied to the fixation unit may be increased in absolute value. Further, the information may be may fed back the control section to adjust the image forming apparatus 100 in such recording medium conveyance conditions as the speed with which motors are driven, speed with which recording medium is conveyed, to improve an image forming apparatus in the conveyance of moist sheets of paper. For example, if a moist of paper is detected, the recording medium conveyance speed may be made slower than the conveyance speed for a dry sheet of paper. That is, an image forming apparatus may be configured so that as the control section detects the presence of a wet sheet of paper, it alters image formation conditions so that the image being formed on the moist sheet of paper will be as close in image quality as an image formed on a dry sheet of paper.

Further, in the preceding embodiments, the transferring member, the electrical resistance of which is detected to detect the presence of a moist sheet of paper, was the transfer roller which formed the transfer section by being placed in contact with the photosensitive drum as an image bearing member. However, these embodiments are not intended to limit the present invention in scope. As is well known in the field of image forming apparatus, in the case of an image forming apparatus of the so-called intermediary transfer type, the toner image formed on the photosensitive drum 1 as the first image bearing member, for example, is transferred (primary transfer) onto an intermediary transfer belt, as the second image bearing member, which is an endless belt. After the toner image is transferred (primary transfer) onto the intermediary transfer belt, it is transferred (secondary transfer) onto recording medium such as a sheet of paper by the function of the secondary transferring member. After the secondary transfer of the toner image onto the recording medium, the recording medium is subjected to a fixation process in the same manner as sheets of recording papers and toner image thereon are subjected by the fixing device in the preceding embodiments. Then, the recording medium is discharged from the main assembly of the image forming apparatus. As the secondary transferring member, a secondary transfer roller which forms the secondary transfer section by being placed in contact with the intermediary transfer belt, is used. Also in the case of an image forming apparatus such as the above-described one, if moist sheets of paper, that is, sheets of recording paper which are relatively high in water content, are used for a printing operation, the secondary transfer roller changes in electrical resistance during the printing operation. Therefore, it is possible to detect the moist sheet of paper by detecting the change which occurs to the electrical resistance of the secondary transfer roller.

Further, the transferring member does not need to be in the form of a roller. For example, it may be in the form of a piece of plate, a brush, a block, etc. That is, the shape of the transferring member is optional.

Further, in the preceding embodiments, the electrical current which flows as voltage is applied to the transferring member was detected by the current detecting device, and the amount of voltage necessary to cause a preset amount of electrical current to flow was obtained to obtain the information related to the electrical resistance of the transferring member. However, the preceding embodiments are not intended to limit the present invention in scope. That is, all that is necessary s to obtain the information related to the electrical resistance of the transferring member. Therefore, the electric current value for obtaining a preset voltage value may be obtained by detecting the voltage value when voltage is applied to the transferring member. For example, in a case where the transfer voltage is controlled to keep constant the transfer current, a desired value for the transfer voltage can be obtained based on the current value which is obtainable by applying voltage, while keeping the voltage constant, to the transferring member during the pre-rotation process. In this case, the detecting means can detect the information correlated to the electrical resistance of the transferring member, by detecting the value of the electrical current which flows as voltage is applied, while being kept constant, to the transferring member by the voltage applying means.

Further, in the preceding embodiments, the heating means was the fixation unit for fixing an unfixed toner image to the recording medium. However, the preceding embodiments are not intended to limit the present invention in terms of heating means. That is, some image forming apparatuses have a glossing device (image heating device), as a heating means, for reheating the recording medium after the fixation of a toner image thereto, in addition to a fixation unit for fixing an unfixed toner image to the recording medium. In the case of these image forming apparatuses, it is possible to feed the results of the detection of a moist sheet of paper back to the adjustment of the temperature setting of the glossing device.

According to the present invention, it is possible to more accurately determine whether or not an image is being formed on a sheet of the recording medium which is relatively high in water content, and therefore, to properly control the generation of water vapor, and/or remove the generated water vapor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-070602 filed on Mar. 28, 2014, which is hereby incorporated by reference herein in its entirety.

What is claimed is:

1. An image forming apparatus comprising:

a main assembly;

an image bearing member configured to carry a toner image;

a transfer member cooperative with said image bearing member to form a transfer portion to transfer a toner image onto a recording material passing through said transfer portion;

a transferring voltage source configured to apply a voltage to said transfer member;

a heating unit configured to heat the recording material having a transferred toner image;

a detecting unit configured to detect a value relating to the amount of water vapor in said main assembly;

a fan configured to adjust a flow rate in said main assembly, and a control unit configured to control a humidity decreasing operation for decreasing the amount of vapor produced in said main assembly;

wherein when said control unit increases the rotational speed of said fan to effect the humidity decreasing operation on the basis of the amount of change of the value detected by said detecting unit, the value corresponding to the amount of the vapor produced by heating the recording material by said heating unit.

2. An image forming apparatus comprising:

a main assembly;

an image bearing member configured to carry a toner image;

a transfer member cooperative with said image bearing member to form a transfer portion to transfer a toner image onto a recording material passing through said transfer portion;

a transferring voltage source configured to apply a voltage to said transfer member;

a detecting unit configured to detect a voltage applied by said transferring voltage source;

a heating unit configured to heat the recording material having a transferred toner image; and a control unit configured to control said heating unit, wherein said detecting unit detects a first voltage at a first timing at which the recording material is not in said transfer portion, and after said heating unit heats at least one recording material thereafter, said detecting unit detects a second voltage having the same polarity as the first voltage and having an absolute value smaller than that of the first voltage, at a second timing at which the recording material is not in said transfer portion, and wherein said control unit controls said heating unit on the basis of a difference between the first voltage and the second voltage so as to reduce an amount of the water vapor produced in said main assembly.

3. An apparatus according to claim 2, wherein said control unit controls said heating unit to reduce the amount of the water vapor produced in said main assembly, when the difference exceeds a predetermined threshold.

4. An apparatus according to claim 3, wherein said control unit changes the predetermined threshold on the basis of the first voltage.

5. An apparatus according to claim 4, wherein the predetermined threshold set when the first voltage is a first value is higher than that set when the first voltage is a second value smaller than the first value.

6. An apparatus according to claim 2, wherein said control unit decreases the heating temperature by said heating unit so as to reduce the amount of water vapor produced in said main assembly.

7. An apparatus according to claim 2, wherein said control unit detects the first voltage by said detecting unit before a first recording material in a plurality of image forming operations on the recording materials passes the transfer portion.

8. An apparatus according to claim 2, wherein said detecting device detects a voltage at the time when a constant current controlled voltage is applied to said transfer member by said transferring voltage source.

9. An image forming apparatus comprising:

a main assembly;

an image bearing member configured to carry a toner image;

a transfer member cooperative with said image bearing member to form a transfer portion to transfer a toner image onto a recording material passing through said transfer portion;

a transferring voltage source configured to apply a voltage to said transfer member;

a detecting unit configured to detect a voltage for applying by said transferring voltage source;

a heating unit configured to heat the recording material having a transferred toner image;

a fan configured to control a flow rate in said main assembly;

a control unit configured to control said fan, wherein said control unit detects a first voltage at a first timing at which the recording material is not in said transfer portion, and after said heating unit heats at least one recording material thereafter, said detecting unit detects a second voltage having the same polarity as the first voltage and having an absolute value smaller than that of the first voltage, at a second timing at which the recording material is not in said transfer portion, and wherein said control unit controls said fan on the basis of a difference between the first voltage and the second voltage so as to reduce an amount of the water vapor produced in said main assembly.

10. An apparatus according to claim 9, wherein said control unit controls said heating unit to reduce the amount of the water vapor produced in said main assembly, when the difference exceeds a predetermined threshold.

11. An apparatus according to claim 10, wherein said control unit changes the predetermined threshold on the basis of the first voltage.

12. An apparatus according to claim 11, wherein the predetermined threshold set when the first voltage is a first value is higher than that set when the first voltage is a second value smaller than the first value.

13. An apparatus according to claim 9, wherein said control unit increases a rotational frequency of said fan so as to reduce the amount of water vapor in said main assembly.

14. An apparatus according to claim 9, wherein said control unit detects the first voltage by said detecting unit before a first recording material in a plurality of image forming operations on the recording materials passes the transfer portion.

15. An apparatus according to claim 9, wherein said detecting unit detects a voltage at the time when a constant current controlled voltage is applied to said transfer member by said transferring voltage source.

* * * * *